US010301700B2

(12) United States Patent
Hammer et al.

(10) Patent No.: US 10,301,700 B2
(45) Date of Patent: May 28, 2019

(54) METHOD FOR PRODUCING A STEEL COMPONENT

(71) Applicant: THYSSENKRUPP STEEL EUROPE AG, Duisburg (DE)

(72) Inventors: Brigitte Hammer, Voerde (DE); Thomas Heller, Duisburg (DE); Frank Hisker, Bottrop (DE); Rudolf Kawalla, Bobritzsch (DE); Grzegorz Korpala, Freiberg (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 311 days.

(21) Appl. No.: 14/913,592

(22) PCT Filed: Aug. 18, 2014

(86) PCT No.: PCT/EP2014/067571
§ 371 (c)(1),
(2) Date: Feb. 22, 2016

(87) PCT Pub. No.: WO2015/024903
PCT Pub. Date: Feb. 26, 2015

(65) Prior Publication Data

US 2016/0201157 A1 Jul. 14, 2016

(30) Foreign Application Priority Data

Aug. 22, 2013 (EP) ..... 13181374

(51) Int. Cl.
*C21D 9/46* (2006.01)
*C22C 38/34* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 6,190,469 B1 2/2001 Koh et al.
6,328,826 B1 12/2001 Iung et al.
(Continued)

FOREIGN PATENT DOCUMENTS

CN 1764730 A 4/2006
CN 101292049 A 10/2008
(Continued)

OTHER PUBLICATIONS

Int'l Search Report for PCT/EP2014/067571 dated Nov. 10, 2014 (dated Jan. 26, 2015).
(Continued)

*Primary Examiner* — Colleen P Dunn
*Assistant Examiner* — Anthony M Liang
(74) *Attorney, Agent, or Firm* — The Webb Law Firm

(57) ABSTRACT

A complexly formed steel component may have a tensile strength Rm of greater than 1200 MPa and an elongation at break A50 of greater than 6%. Example methods for producing such components comprise providing a flat steel product, which in addition to iron and unavoidable impurities, contains in percent by weight 0.10-0.60% C, 0.4-2.5% Si, up to 3.0% Al, 0.4-3.0% Mn, up to 1% Ni, up to 2.0% Cu, up to 0.4% Mo, up to 2% Cr, up to 1.5% Co, up to 0.2% Ti, up to 0.2% Nb, and up to 0.5% V. At least 10% by volume of a microstructure of the flat steel product may consist of
(Continued)

residual austenite comprising globular residual austenite islands with a grain size of at least 1 μm. Before being cooled, the flat steel product may be heated to a forming temperature of 150-400° C. and formed into a component with a degree of forming that is at most equal to uniform elongation Ag.

6 Claims, 4 Drawing Sheets

(51) Int. Cl.

| | |
|---|---|
| ***C21D 6/00*** | (2006.01) |
| ***C21D 8/02*** | (2006.01) |
| ***C22C 38/42*** | (2006.01) |
| ***C23C 30/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/18*** | (2006.01) |
| *C21D 7/10* | (2006.01) |
| *C21D 9/00* | (2006.01) |

(52) U.S. Cl.

CPC ..... *C21D 8/0205* (2013.01); *C21D 8/0221* (2013.01); *C21D 8/0226* (2013.01); *C21D 8/0236* (2013.01); *C22C 38/02* (2013.01); *C22C 38/04* (2013.01); *C22C 38/06* (2013.01); *C22C 38/08* (2013.01); *C22C 38/16* (2013.01); *C22C 38/18* (2013.01); *C22C 38/34* (2013.01); *C22C 38/42* (2013.01); *C23C 30/005* (2013.01); *C21D 7/10* (2013.01); *C21D 9/0068* (2013.01); *C21D 2211/001* (2013.01)

(56) References Cited

U.S. PATENT DOCUMENTS

| | | | | |
|---|---|---|---|---|
| 6,364,968 | B1 | 4/2002 | Yasuhara et al. | |
| 7,591,977 | B2 | 9/2009 | Ikeda et al. | |
| 8,932,414 | B2 * | 1/2015 | Hata | C21D 8/0226 148/320 |
| 2005/0028898 | A1 | 2/2005 | Guelton et al. | |
| 2006/0060269 | A1 | 3/2006 | Nakano et al. | |
| 2008/0199347 | A1 | 8/2008 | Barges et al. | |
| 2009/0107588 | A1 * | 4/2009 | Allain | C21D 1/19 148/547 |
| 2010/0172786 | A1 | 7/2010 | Nakaya et al. | |
| 2010/0307641 | A1 * | 12/2010 | Im | C21D 1/20 148/506 |
| 2010/0307644 | A1 | 12/2010 | Gil Otin et al. | |
| 2011/0146852 | A1 | 6/2011 | Matsuda et al. | |
| 2011/0162762 | A1 | 7/2011 | Matsuda et al. | |
| 2012/0211128 | A1 | 8/2012 | Corquillet et al. | |
| 2013/0048161 | A1 | 2/2013 | Matsuda et al. | |
| 2013/0087253 | A1 | 4/2013 | Matsuda et al. | |
| 2013/0167986 | A1 | 7/2013 | Teramoto et al. | |
| 2013/0236350 | A1 * | 9/2013 | Kakiuchi | C21D 8/0426 420/84 |
| 2013/0240093 | A1 | 9/2013 | Okada et al. | |
| 2016/0215360 | A1 | 7/2016 | Köyer et al. | |

FOREIGN PATENT DOCUMENTS

| | | | |
|---|---|---|---|
| CN | 101460645 | A | 6/2009 |
| CN | 103201401 | A | 7/2013 |
| CN | 103201404 | A | 7/2013 |
| EP | 1466024 | | 10/2004 |
| EP | 1553202 | A1 | 7/2005 |
| EP | 1975266 | A1 | 10/2008 |
| EP | 2105514 | A1 | 9/2009 |
| EP | 2246456 | A1 | 11/2010 |
| EP | 2267176 | A1 | 12/2010 |
| EP | 2325346 | A1 | 5/2011 |
| EP | 2327810 | A1 | 6/2011 |
| EP | 2436794 | A1 | 4/2012 |
| EP | 2546382 | A1 | 1/2013 |
| JP | 1159317 | A | 6/1989 |
| JP | 200418971 | A | 1/2004 |
| JP | 200597725 | A | 4/2005 |
| JP | 2005097725 | A | 4/2005 |
| JP | 201065272 | A | 3/2010 |
| JP | 201065273 | A | 3/2010 |
| JP | 2010180446 | A | 8/2010 |
| JP | 201292358 | A | 5/2012 |
| JP | 2012122129 | A | 6/2012 |
| JP | 2012240095 | A | 12/2012 |
| WO | 2011111330 | A1 | 9/2011 |
| WO | 2011111333 | A1 | 9/2011 |
| WO | 2012063620 | A1 | 5/2012 |

OTHER PUBLICATIONS

"Thermodynamic extrapolation and martensite-start temperature of substitutionally alloyed steels" by H. Bhadeshia, appearing in Metal Science 15 (1981), pp. 178-180.

Bhadeshia et al., The Bainite Transformation in a Silicon Steel, Metallurgical Transactions, Jul. 1979, pp. 895-907, vol. 10A, American Society for Metals and the Metallurgical Society of AIME.

Bhadesia, H., Thermodynamic extrapolation and martensite-start temperature of substantially alloyed steels, Metal Science, Apr. 1981, pp. 178-180.

Bhadeshia et al., Bainite in Silicon Steels: New Composition-Property Approach Part 1, Sep. 1983, pp. 411-419, Metal Science, vol. 17.

Bhadeshia et al., Bainite in Silicon Steels: New Composition-Property Approach Part 2, Sep. 1983, pp. 420-425, Metal Science, vol. 17.

Caballero et al., Design of Advanced Bainitic Steels by Optimisation of TTT Diagrams and To Curves, ISIJ, 2006, pp. 1479-1488, vol. 46.

Caballero et al., Theoretical Design and Advanced Microstructure in Super High Strength Steels, Materials and Design, 2009, pp. 2077-2083, vol. 30.

* cited by examiner

METHOD FOR PRODUCING A STEEL COMPONENT

CROSS REFERENCE TO RELATED APPLICATIONS

This application is a U.S. National Stage Entry of International Patent Application Serial Number PCT/EP2014/067571, filed Aug. 18, 2014, which claims priority to European Patent Application No. EP13181374.3 filed Aug. 22, 2013, the entire contents of both of which are incorporated herein by reference.

FIELD

The present disclosure relates to methods for producing high-strength steel components.

BACKGROUND

As a preliminary matter, the term 'flat steel product' is understood here as meaning steel sheets or steel strips produced by a rolling process and also sheet bars and the like cut off from said sheets or strips. Steel components of the type according to the invention are produced by a forming process from such flat steel products.

Unless otherwise expressly stated, whenever alloying contents are given here merely in "%", this always means "% by weight".

When reference is made here to "elongation at break A50", "elongation at break A80" or "tensile strength Rm", the mechanical characteristic values determined in accordance with DIN EN 6892-1 are meant.

Furthermore, U.S. Pat. No. 6,364,968 B1 discloses a method for producing a hot-rolled steel sheet which is intended to have a uniform distribution of its mechanical properties and particularly good hole-expanding characteristics in the case of a thickness of no more than 3.5 mm. The method thereby provides that a slab which comprises (in % by weight) 0.05-0.30% C, 0.03-1.0% Si, 1.5-3.5% Mn, up to 0.02% P, up to 0.005% S, up to 0.150% Al, up to 0.0200% N and alternatively or in combination 0.003-0.20% Nb or 0.005-0.20% Ti, is heated to up to 1200° C. and is then hot-rolled at a final hot-rolling temperature of at least 800° C., in particular 950-1050° C., into a hot strip. Then the hot strip obtained is cooled down at a cooling-down rate of 20-150° C./sec to a coiling temperature of 300-550° C., at which it is wound into a coil. The cooling down commences in this case within 2 seconds from the end of the hot rolling. The hot strip thus obtained is intended to have a fine bainitic microstructure with a bainite fraction of at least 90%, the average grain size of which does not exceed 3.0 μm, it being intended that the ratio of the length of the longest axis to the length of the shortest axis of the grains is no more than 1.5 and the length of the longest axis of the grains is no more than 10 μm. The remainder of the microstructure that is not taken up by the bainite is to consist of tempered martensite, which in its appearance and properties is very similar to the bainite. Hot strips produced in this way and of this form have tensile strengths of 850-1103 MPa with an elongation of 15-23%.

EP 2 546 382 A1 also discloses a method for producing a steel sheet with a tensile strength of at least 1470 MPa, in which the product of elongation and tensile strength is at least 29 000 MPa %. In addition to iron and unavoidable impurities, the steel of which the steel sheet consists in this case contains (in % by weight) 0.30-0.73% C, up to 3.0% Si, up to 3.0% Al, the sum of the Si and Al contents being at least 0.7%, 0.2-8.0% Cr, up to 10.0% Mn, the sum of the Cr and Mn contents being at least 1.0%, up to 0.1% P, up to 0.07% S and also up to 0.010% N. The steel sheet of such a composition is processed in such a way that the proportion by area of martensite in relation to the entire microstructure of the steel lies in the range of 15-90% and the amount of residual austenite contained in the microstructure is 10-50%. In this case, at least 50% of the martensite is intended to take the form of tempered martensite and the proportion by area of the tempered martensite is intended to be at least 10%. If they are present in the microstructure, at the same time the proportion by area of polygonal ferrites present in the microstructure should be at most 10%.

In order to achieve this, according to EP 2 546 382 A1 first a hot-rolled steel strip of the specified composition is produced by a preliminary steel material, such as a slab, being heated to 1000-1300° C. and, after that, rolled at a final hot-rolling temperature of 870-950° C. into a hot strip. The hot strip obtained is then wound into a coil at a coiling temperature of 350-720° C. After the coiling, a pickling is performed with subsequent cold rolling with degrees of deformation of 40-90%. The cold-rolled strip thus obtained is annealed for 15-1000 seconds at a temperature at which it has a purely austenitic microstructure, and is then cooled down at a cooling-down rate of at least 3° C./s to a temperature that lies in a temperature range beginning below the martensite start temperature and extending down to a temperature 150° C. lower, in order to produce tempered martensite in the microstructure of the steel sheet. After that, the cold-rolled steel strip is heated over a period of 15-1000 seconds to 340-500° C., in order to stabilize the residual austenite present. The cold-rolled steel sheets thus produced have achieved tensile strengths of more than 1600 MPa with an elongation of up to 27%.

DETAILED DESCRIPTION

Figure 1:
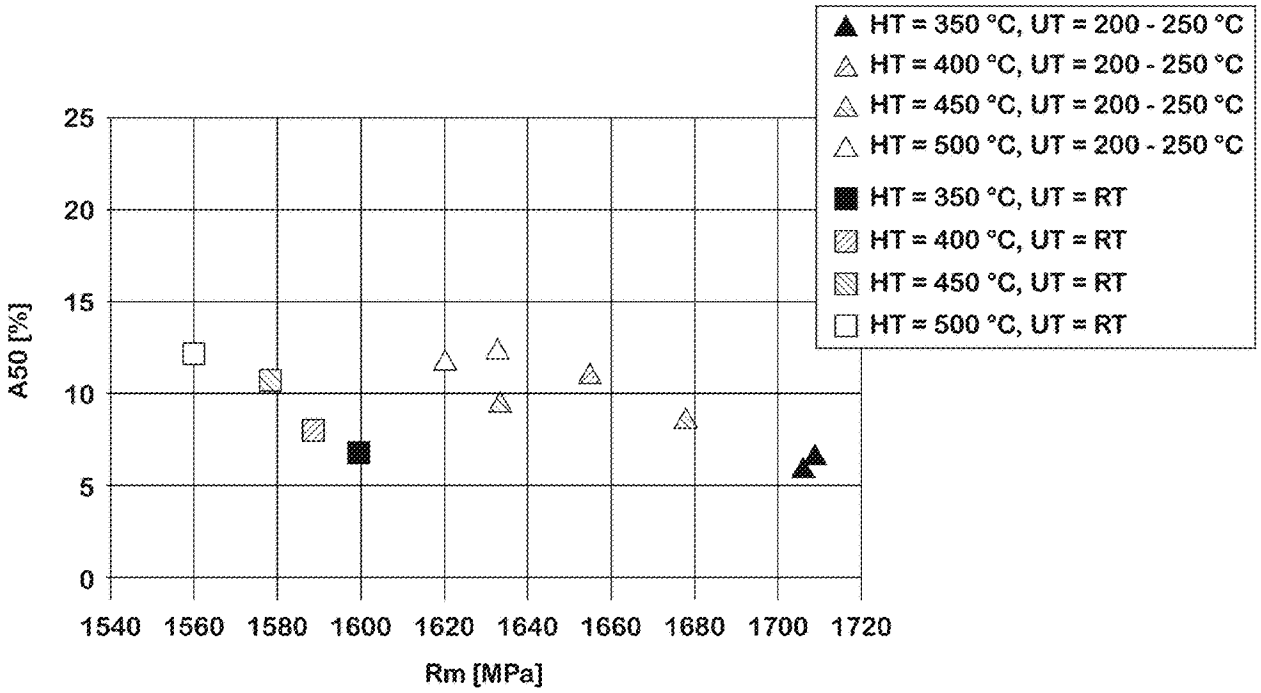
FIG. 1 is a diagram showing elongation at break A50 plotted against tensile strength Rm for four example hot-rolled flat steel products of a same composition S1 as example components B1, B2, B3, and B4 produced according to an example method of the present disclosure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Steel components produced according to the present disclosure are distinguished by a very high strength in combination with good elongation properties and, as such, are suitable in particular as components for motor vehicle bodies, amongst other things. Moreover, in some examples, the steel components have a tensile strength Rm of more than 1200 MPa and an elongation at break A50 of at least 6%.

Against the background of the prior art explained above, the object of the invention was to provide a method which allows in a simple way the production of complexly formed components from flat steel products of the type explained above.

The method according to the invention is suitable for producing a steel component that has a tensile strength Rm of more than 1200 MPa and an elongation at break A50 of at least 6%. For this purpose, the method according to the invention comprises the following working steps:

providing a flat steel product which, in addition to iron and unavoidable impurities, contains (in % by weight):
- C: 0.10-0.60%,
- Si: 0.4-2.5%,
- Al: up to 3.0%
- Mn: 0.4-3.0%,
- Ni: up to 1%,
- Cu: up to 2.0%,
- Mo: up to 0.4%,
- Cr: up to 2%,
- Co: up to 1.5%,
- Ti: up to 0.2%,
- Nb: up to 0.2%,
- V: up to 0.5%, wherein at least 10% by volume of the microstructure of the flat steel product consists of residual austenite, which comprises globular residual austenite islands with a grain size of at least 1 μm, heating the flat steel product to a forming temperature, which is 150-400° C., forming the flat steel product heated to the forming temperature into a component with a degree of forming that is at most uniform elongation Ag, also known in practice as the elongation under forming or the degree of deformation, cooling down of the component obtained.

The invention is based on the finding that a component produced by subjecting a flat steel product at 150-400° C. of the type provided by the invention to a forming process has after subsequent cooling down to room temperature a significantly increased strength in comparison with the strength of the original flat steel product, with virtually unchanged elongation properties.

As a consequence of the heating in the temperature range prescribed according to the invention, the ductility of the flat steel product processed according to the invention increases significantly, so that, without any particular effort and with minimized risk, the occurrence of cracks can be obviated and component forms that have a particularly complex configuration can be produced. Practical tests have shown here that flat steel products of the type provided according to the invention often achieve an elongation at break A50 of at least 30% in the temperature range in which the forming is intended to take place according to the invention, whereas the elongation at break A50 of the component at room temperature is unchanged in comparison with the flat steel product serving as a starting product, in the region of typically 22%.

Surprisingly, in spite of the increased strength, the elongation properties of a component produced according to the invention do not decrease in comparison with a component formed at room temperature. Consequently, by a pre-deformation at 150-400° C., the invention provides a significant increase in strength with unchanged ductility of the component obtained in each case.

The cooling down that takes place after the forming process does not require any particular effort. The cooling down of the flat steel product that is performed after the forming process can thus take place in still air.

The increase in strength that is achieved by the forming performed according to the invention is considerable. It has thus been possible to demonstrate that, by subjecting a component to a 15% forming process, carried out at temperatures elevated according to the invention, it has often been possible to increase the tensile strength by about 80-120 MPa in comparison with the tensile strength of test pieces that have likewise been subjected to forming with a degree of forming of 15%, but at room temperature. At the same time, the elongation properties of the component obtained according to the invention correspond to the elongation properties of the component subjected to forming at room temperature, so that, on account of its deformation characteristics, the component produced according to the invention is suitable in particular for use in automobile bodies.

According to the findings of the invention, the reason for the increase in strength achieved by the procedure according to the invention is that globular residual austenite that is present in the microstructure of the flat steel product processed according to the invention and is characterized by a grain size of at least 1 μm is transformed under the load of the forming process in the temperature range prescribed according to the invention of 150-400° C. into film-like residual austenite and bainitic ferrite or, below the martensite start temperature, into martensite. During the forming process in the temperature range concerned, the globular residual austenite present in the flat steel product consequently contributes to the increase in the elongation. After the forming and cooling down of the component, the steel processed according to the invention then displays higher tensile strengths as a consequence of the additionally formed ferritic bainite or martensite. The fractions of film-like residual austenite, remaining unchanged over the course of the cooling-down process, ensure the good residual elongation that is achieved after the forming process. This effect can be used particularly dependably if, for undergoing the process of being formed into the component in the way according to the invention, the flat steel product is heated to 200-400° C., in particular 200-300° C.

On account of the comparably low temperatures at which the forming is carried out according to the invention, the method according to the invention is suitable in particular for forming into components flat steel products that are provided with a metallic protective coating. The metallic protective layer is influenced at most slightly by the heating performed according to the invention. The protective coating may be for example a conventional zinc, zinc-alloy, aluminum or aluminum-alloy, magnesium or magnesium-alloy coating.

The composition of a flat steel product processed according to the invention has been chosen with the following aspects taken into consideration:

Carbon contained in amounts of 0.1-0.6% by weight delays the transformation into ferrite/perlite in the steel of the flat steel product processed according to the invention, lowers the martensite start temperature MS and contributes to the increase in hardness. In order to use these positive effects, the C content of the flat steel product according to the invention is set to at least 0.25% by weight, in particular at least 0.27% by weight, at least 0.28% by weight or at least 0.3% by weight, the effects that are achieved by the comparatively high carbon content being able to be used particularly dependably when the C content lies in the range of >0.25-0.5% by weight, in particular 0.27-0.4% by weight or 0.28-0.4% by weight.

The presence of Si, contained in amounts of 0.4-2.5% by weight, and Al, contained in amounts of up to 3% by weight, in the flat steel product processed according to the invention allows the formation of carbides in the bainite to be suppressed and, as an accompanying effect, the residual austenite to be stabilized by dissolved carbon. Moreover, Si contributes to the solid-solution strengthening. In order to avoid possibly harmful influences of Si, the Si content may be restricted to 2.0% by weight. In order to use Si as a solid-solution former for increasing strength, it may be expedient if the flat steel product processed according to the invention contains at least 1% by weight Si.

Al may partly substitute the Si content in the steel processed according to the invention. A minimum content of 0.4% by weight Al may be provided for this. This applies in particular whenever the hardness or tensile strength of the steel is to be adjusted to a lower value in favor of improved deformability by the addition of Al.

The positive influences of the simultaneous presence of Al and Si can be used particularly effectively whenever the contents of Si and Al within the limits prescribed according to the invention satisfy the condition % Si+0.8% Al>1.2% by weight or even the condition % Si+0.8% Al>1.5% by weight (with % Si: the respective Si content in % by weight, % Al: the respective Al content in % by weight).

Mn contained in amounts of at least 0.4% by weight and up to 3.0% by weight, in particular up to 2.5% by weight or 2.0% by weight, is conducive in the steel processed according to the invention to bainite formation, the contents of Cu, Cr and Ni that are optionally additionally present likewise contributing to the formation of bainite. Depending on the other constituents in each case of the steel processed according to the invention, it may be expedient in this respect to restrict the Mn content to a maximum of 1.6% by weight or 1.5% by weight.

The optional addition of Cr allows the martensite start temperature to be lowered and the tendency of the bainite to be transformed into perlite or cementite to be suppressed. Furthermore, contained in amounts up to the upper limit prescribed according to the invention of a maximum of 2% by weight, Cr is conducive to the ferritic transformation, optimum effects of the presence of Cr being obtained in a flat steel product according to the invention when the Cr content is restricted to 1.5% by weight.

The optional addition of Ti, V or Nb allows the occurrence of a fine-grained microstructure to be supported and the ferritic transformation to be promoted. In addition, by the formation of precipitates, these microalloying elements contribute to the increase in hardness. The positive effects of Ti, V and Nb can be used particularly effectively in the flat steel product processed according to the invention when their content lies in each case in the range of 0.002-0.15% by weight, in particular does not exceed 0.14% by weight.

The formation of the microstructure provided according to the invention can be ensured in particular by the contents of Mn, Cr, Ni, Cu and C in the flat steel product processed according to the invention satisfying the following condition $$1<0.5\%\ Mn+0.167\%\ Cr+0.125\%\ Ni+0.125\%\ Cu+1.334\%\ C<2,$$

% Mn denoting the respective Mn content in % by weight, % Cr the respective Cr content in % by weight, % Ni the respective Ni content in % by weight, % Cu the respective Cu content in % by weight and % C the respective C content in % by weight.

Suitable in principle as the starting product for the method according to the invention are hot-rolled or cold-rolled flat steel products with a composition as specified according to the invention. Hot-rolled flat steel products that come into consideration for this and a method for their production are the subject of European patent application EP 12 17 83 30.2, which was filed Jul. 27, 2012, is entitled 'Hot-rolled Steel Flat Product and Method for Its Production,' and is now published as European Patent Publication No. EP2690183A1, the content of which is hereby expressly incorporated into the disclosure of the present patent application.

As explained in the cited European patent application EP 12 17 83 30.2, the hot-rolled flat steel products produced according to this patent application are distinguished by an optimum combination of elongation properties and strength. This combination of properties can be achieved particularly dependably by the microstructure of flat steel products processed according to the invention consisting, in addition to optionally present fractions of up to 5% by volume ferrite and up to 10% by volume martensite, of bainite in a proportion of at least 60% by volume and of residual austenite as the remainder, wherein the residual austenite content is at least 10% by volume, at least part of the residual austenite is in block form and at least 98% of the blocks of the residual austenite that takes a block form have an average diameter of less than 5 μm.

A hot-rolled flat steel product of the form according to EP 12 17 83 30.2 accordingly has a microstructure dominated by two phases, the one dominant constituent of which is bainite and the second dominant constituent of which is residual austenite. In addition to these two main components, small fractions of martensite and ferrite may be present, the contents of which are however too small to have an influence on the properties of the hot-rolled flat steel product.

"Block-like" residual austenite is the term used in this connection if, in the case of the structural constituents of residual austenite that are present in the microstructure, the ratio of length/width, i.e. longest extent/thickness, is 1 to 5. By contrast, residual austenite is referred to as "film-like" if, in the case of the residual austenite accumulations that are present in the microstructure, the ratio of length/width is greater than 5 and the width of the respective microstructural constituents of residual austenite is less than 1 μm. Film-like residual austenite accordingly typically takes the form of finely distributed lamellae.

A method for producing a hot-rolled flat steel product suitable as a starting product for the method according to the invention comprises the following working steps:

providing a preliminary product in the form of a slab, thin slab or a cast strip which, in addition to iron and unavoidable impurities, contains (in % by weight) 0.10-0.60% C, 0.4-2.0% Si, up to 2.0% Al, 0.4-2.5%

Mn, up to 1% Ni, up to 2.0% Cu, up to 0.4% Mo, up to 2% Cr, up to 0.2% Ti, up to 0.2% Nb and up to 0.5% V;

hot rolling the preliminary product into a hot strip in one or more rolling passes, the hot strip obtained having a final hot-rolling temperature of at least 880° C. when it leaves the last rolling pass;

accelerated cooling down of the hot strip obtained at a cooling-down rate of at least 5° C./s to a coiling temperature, which lies between the martensite start temperature MS and 600° C.;

coiling the hot strip into a coil;

cooling down the coil, wherein, for the forming of bainite, the temperature of the coil during the cooling down is kept in a temperature range of which the upper limit is equal to the bainite start temperature BS, from which bainite occurs in the microstructure of the hot strip, and of which the lower limit is equal to the martensite start temperature MS, from which martensite occurs in the microstructure of the hot strip, until at least 60% by volume of the microstructure of the hot strip consists of bainite.

A cold-rolled flat steel product suitable as a starting product for carrying out the method according to the invention and a method for producing such a cold-rolled flat steel product are the subject of European patent application 12 17 83 32.8, which was filed Jul. 27, 2012, is entitled 'Cold Rolled Steel Flat Product and Method for Its Production,' and is now published as European Patent Publication No. EP2690184A1, the content of which is hereby likewise expressly incorporated into the disclosure of the present patent application.

In the case of an alloy included within the steel composition prescribed according to the invention, the microstructure of the cold-rolled flat steel product preferably consists of at least 20% by volume bainite, 10-35% by volume residual austenite and martensite as the remainder. It goes without saying here that technically unavoidable traces of other structural constituents may be present in the microstructure. Such a cold-rolled flat steel product suitable for the processing according to the invention accordingly has a three-phase microstructure, the dominant constituent of which is bainite and which additionally consists of residual austenite and, as a remainder, martensite. Optimally, the bainite fraction is at least 50% by volume, in particular at least 60% by volume, and the residual austenite fraction is in the range of 10-25% by volume, here too the remainder of the microstructure being respectively made up by martensite. The optimum martensite fraction is at least 10% by volume. With the high tensile strength Rm that is required for a cold-rolled flat steel product processed according to the invention of typically at least 1400 MPa and an elongation at break A80 of at least 5%, a microstructure of such a composition brings about an optimum product Rm×A80 of elongation and tensile strength. In addition to the main components "bainite", "residual austenite" and "martensite", in the cold-rolled flat steel product processed according to the invention there may be contents of other structural constituents, the fractions of which are however too small to have an influence on the properties of the cold-rolled flat steel product. In the case of a flat steel product of such a form, suitable for processing according to the invention, the residual austenite is predominantly film-like, with small globular islands of block-like residual austenite with a grain size of <5 μm, so that the residual austenite has a great stability and an accompanying low tendency to undergo undesired transformation into martensite. The C content of the residual austenite is in this case typically more than 1.0% by weight.

A method for producing a cold-rolled flat steel product of such a form and processed according to the invention comprises the following working steps:

providing a preliminary product in the form of a slab, thin slab or a cast strip which, in addition to iron and unavoidable impurities, contains (in % by weight) C: 0.10-0.60%, Si: 0.4-2.5%, Al: up to 3.0%, Mn: 0.4-3.0%, Ni: up to 1.0%, Cu: up to 2.0%, Mo: up to 0.4%, Cr: up to 2%, Co: up to 1.5%, Ti: up to 0.2%, Nb: up to 0.2%, V: up to 0.5%;

hot rolling the preliminary product into a hot strip in one or more rolling passes, the hot strip obtained having a final hot-rolling temperature of at least 830° C. when it leaves the last rolling pass;

coiling the hot strip obtained at a coiling temperature which lies between the final hot-rolling temperature and 560° C.;

cold rolling the hot strip into a cold strip with a degree of cold rolling of at least 30%;

heat treating the cold strip obtained, wherein, in the course of the heat treatment, the cold strip is heated to an annealing temperature of at least 800° C., is optionally kept at the annealing temperature over an annealing period of 50-150 s, is cooled down from the annealing temperature at a cooling-down rate of at least 8° C./s to a holding temperature, which lies in a holding temperature range of which the upper limit is 470° C. and of which the lower limit is higher than the martensite start temperature MS, from which martensite occurs in the microstructure of the cold strip, and is kept in the holding temperature range over a time period that is sufficient to form at least 20% by volume bainite in the microstructure of the cold strip.

The aforementioned martensite start temperature, i.e. the temperature from which martensite forms in steel processed according to the invention, may be calculated in each case according to the procedure explained in the article "Thermodynamic extrapolation and martensite-start temperature of substitutionally alloyed steels" by H. Bhadeshia, appearing in Metal Science 15 (1981), pages 178-180.

A steel with the composition given in Table 1 was melted.

The steel melt was cast in a conventional way into slabs, which were then heated, in a similarly conventional way, to a reheating temperature OT.

The heated slabs were hot-rolled in a likewise conventional hot-rolling line into hot strips W1-W4 with a thickness of in each case 2.0 mm.

The hot strips W1-W4 emerging from the hot-rolling line had in each case a final hot-rolling temperature ET, from which they were cooled down at an accelerated cooling-down rate KR to a coiling temperature HT. At this coiling temperature HT, the hot strips W1-W4 were wound into coils.

The coils were then cooled down in each case in a temperature range of which the upper limit was fixed by the respective coiling temperature HT and of which the lower limit was fixed by the martensite start temperature MS calculated for the steel S1. The calculation of the martensite start temperature MS was performed in this case according to the procedure explained in the article "Thermodynamic extrapolation and martensite-start temperature of substitutionally alloyed steels" by H. Bhadeshia, appearing in Metal Science 15 (1981), pages 178-180.

The period over which the coil was cooled down in the temperature range defined in the way described above was set such that the hot strips thus obtained had in each case a microstructure consisting of bainite and residual austenite in which the fractions of other structural constituents, if any, were present in ineffective amounts tending toward "0".

The respective operating parameters of the reheating temperature OT, the final hot-rolling temperature ET, the cooling-down rate KR, the coiling temperature HT and the martensite start temperature MS are given in Table 2.

In Table 3, the mechanical properties such as the tensile strength Rm, the yield strength Rp, the elongation at break A80, the quality Rm*A80 and the respective residual austenite content RA determined for the individual hot strips W1-W4 are additionally given.

Test pieces of the flat steel products thus obtained, taking the form of the hot strips W1-W4, were then heated to a forming temperature UT lying in the range of 200-250° C. and formed in each case into a component with a degree of forming of up to 15%. At the temperature UT, the elongation at break A50 of the test pieces was >30%, so that, in the temperature range according to the invention of the forming process, even the formation of complex forming elements was possible without the risk of cracking.

After the forming in the temperature range of 200-250° C., the components fashioned from the test pieces of the hot strips W1-W4 by undergoing a 15% forming process were cooled down to room temperature in air and their elongation at break A50 and their tensile strength Rm were determined.

For comparison, further test pieces of the hot strips W1-W4 were formed into the respective components at room temperature RT, i.e. when cold. The elongation at break A50 and the tensile strength Rm were also determined on the components thus formed.

It was found that, after the cooling down to room temperature, the tensile strength Rm of the test pieces formed according to the invention was in each case 80-120 MPa higher than in the case of the test pieces formed at room temperature, with substantially constant values for the elongation at break A50.

Figure 2:
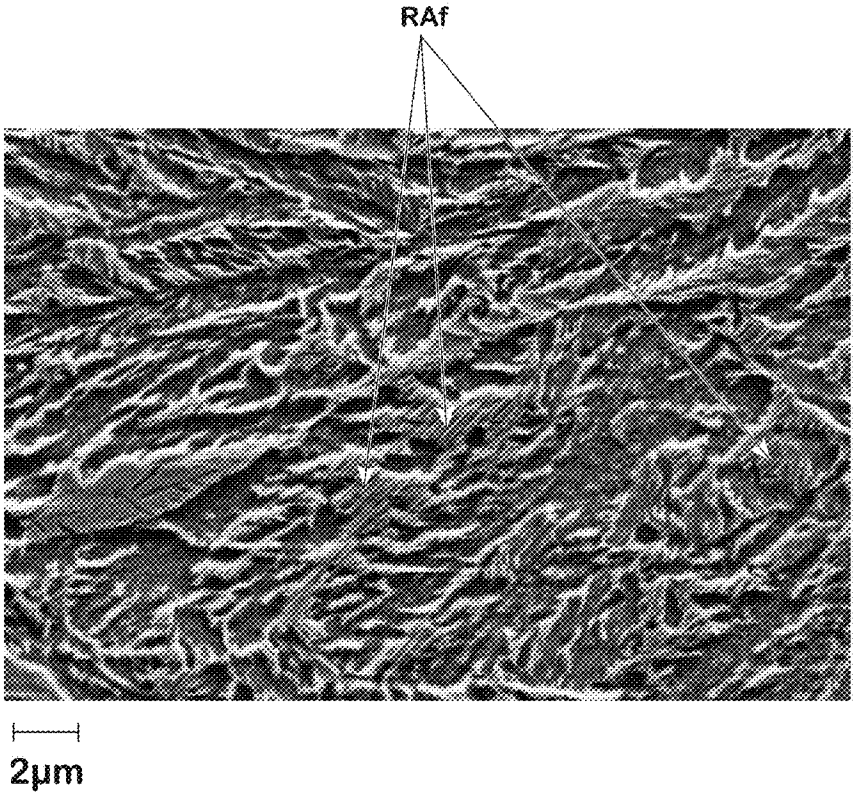
FIG. 2 is an illustration showing an example microstructure specimen of a component B4.

In FIG. 2, a detail of a microstructure specimen is shown, taken at room temperature from the component that was formed in the way according to the invention at temperatures of 200-250° C. from the hot strip W2 consisting of the steel S1. The film-like form taking residual austenite RAf produced from the previously globulitic residual austenite islands by the forming process in the temperature range mentioned can be clearly seen there.

Figure 3A:
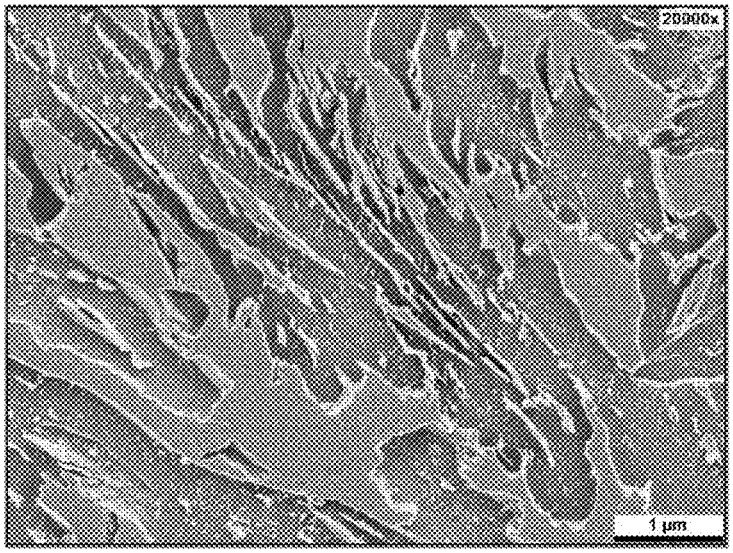
FIG. 3*a* is an illustration of an example microstructure specimen of a flat steel product from which an example component B4 is formed, wherein the illustration is shown in 20,000× magnification before forming.
Figure 3B:
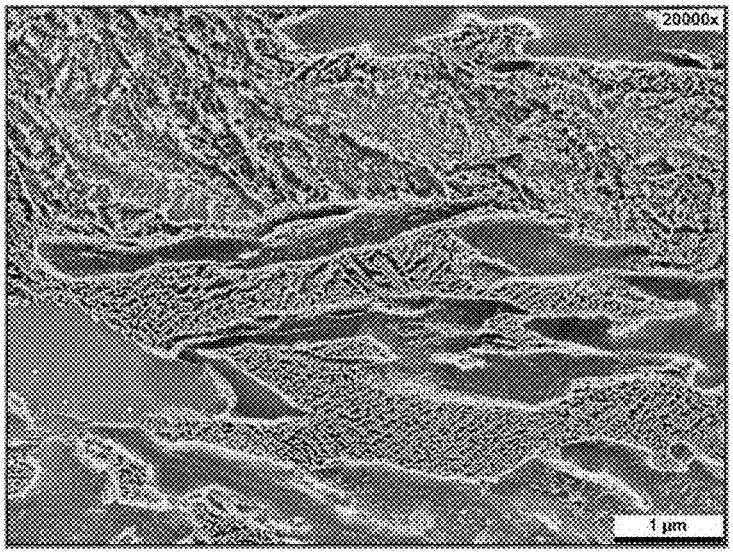
FIG. 3*b* is an illustration of an example microstructure specimen of a flat steel product from which an example component B4 is formed, wherein the illustration is shown in 20,000× magnification after forming.

In FIGS. 3*a*, 3*b*, details of a microstructure specimen of the steel component consisting of the steel S1 before (FIG. 3*a*) and after (FIG. 3*b*) the forming according to the invention are reproduced, in each case with magnification of 20 000×.

Figure 4A:
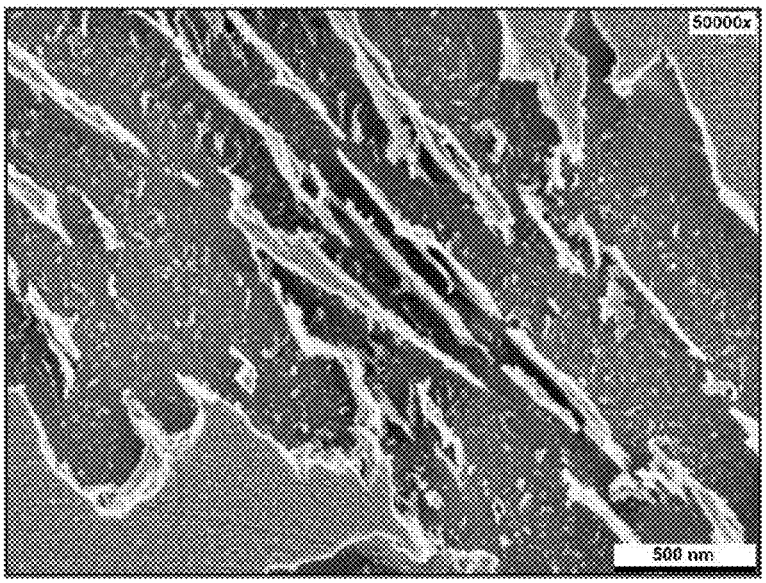
FIG. 4*a* is an illustration of an example microstructure specimen of a flat steel product from which an example component B4 is formed, wherein the illustration is shown in 50,000× magnification before forming.
Figure 4B:
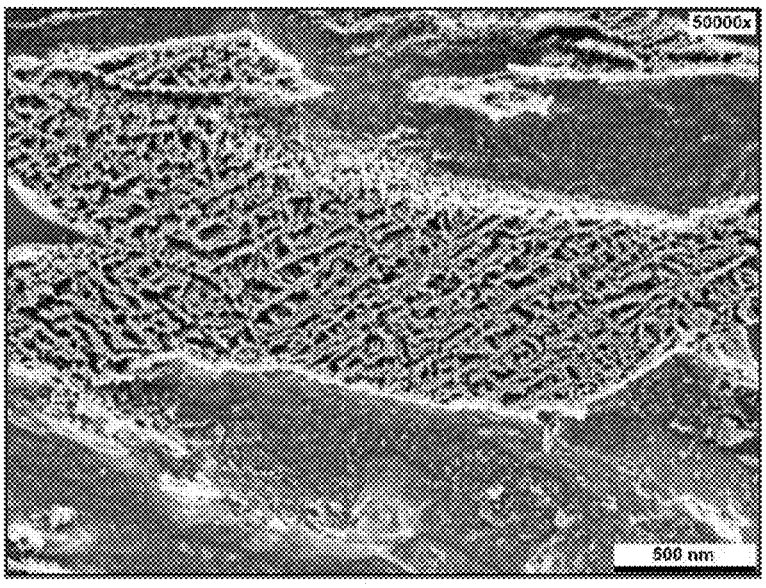
FIG. 4*b* is an illustration of an example microstructure specimen of a flat steel product from which an example component B4 is formed, wherein the illustration is shown in 50,000× magnification after forming.

In FIGS. 4*a*, 4*b* there are corresponding micrographs of the microstructure specimens of the steel component consisting of the steel S1 before (FIG. 4*a*) and after (FIG. 4*b*) the forming according to the invention, with magnification of 50 000×.

The comparison of FIG. 3*a* with FIG. 3*b* and of FIG. 4*a* with FIG. 4*b* also clearly shows the changes that are brought about by a deformation according to the invention.

The method according to the invention consequently allows in a simple way the production of a complexly formed steel component with a tensile strength Rm of >1200 MPa and an elongation at break A50 of >6%. For this purpose, the invention provides a flat steel product which, in addition to iron and unavoidable impurities, contains (in % by weight) C: 0.10-0.60%, Si: 0.4-2.5%, Al: up to 3.0%, Mn: 0.4-3.0%, Ni: up to 1%, Cu: up to 2.0%, Mo: up to 0.4%, Cr: up to 2%, Co: up to 1.5%, Ti: up to 0.2%, Nb: up to 0.2%, V: up to 0.5%, wherein at least 10% by volume of the microstructure of the flat steel product consists of residual austenite which comprises globular residual austenite islands with a grain size of at least 1 μm.

The flat steel product is heated to a forming temperature of 150-400° C. and undergoes the process of being formed into the component at the forming temperature with a degree of forming that is at most equal to the uniform elongation Ag. The flat steel product thus obtained is finally cooled down. A component formed in such a way at elevated temperatures has a significantly increased strength in comparison with components that are of the same flat steel product but formed at room temperature.

TABLE 1

| Steel | C | Si | Al | Mn | Ni | Cu | Cr | Others |
|---|---|---|---|---|---|---|---|---|
| S1 | 0.48 | 1.5 | 0.02 | 1.48 | 0.034 | 1.51 | 0.9 | |

Figures given in % by weight,
the remainder iron and unavoidable impurities

TABLE 2

| Hot strip | OT [° C.] | ET [° C.] | KR [° C./s] | HT [° C.] | MS [° C.] |
|---|---|---|---|---|---|
| W1 | 1150 | 970 | 20 | 350 | 245 |
| W2 | 1200 | 1000 | 10 | 400 | 315 |
| W3 | 1200 | 1000 | 20 | 450 | 270 |
| W4 | 1150 | 1000 | 20 | 500 | 230 |

TABLE 3

| Hot strip | Rm [MPa] | Rp [MPa] | A80 [%] | RM * A80 [MPa * %] | RA [Vol.-%] |
|---|---|---|---|---|---|
| W1 | 1357 | 807 | 22.2 | 27 387 | 36 |
| W2 | 1318 | 751 | 17.8 | 21 328 | 17 |
| W3 | 1217 | 821 | 25.8 | 28 544 | 32 |
| W4 | 1345 | 889 | 21.0 | 25 677 | 30 |

What is claimed is:

1. A method for producing a steel component having a tensile strength Rm of more than 1200 MPa and an elongation at break A50 of more than 6%, the method comprising:

providing a flat steel product that contains iron, unavoidable impurities, 0.30-0.60% by weight C, 0.4-2.5% by weight Si, up to 3.0% by weight Al, 0.4-3.0% by weight Mn, up to 1% by weight Ni, up to 2.0% by weight Cu, up to 0.4% by weight Mo, up to 2% by weight Cr, up to 1.5% by weight Co, up to 0.2% by weight Ti, up to 0.2% by weight Nb, and up to 0.5% by weight V, wherein the flat steel product is a cold-rolled steel strip or steel sheet having a micro structure comprising at least 20% by volume bainite, 10-35% by volume residual austenite, and at least 10% by volume martensite and the residual austenite comprises globular residual austenite islands with a grain size of at least 1 μm;

heating the flat steel product to a forming temperature of 150-400 degrees Celsius;

forming the flat steel product heated to the forming temperature into a component with a degree of forming that is at most equal to a uniform elongation Ag of the flat steel product; and cooling the flat steel product.

2. The method of claim 1 wherein amounts of Mn, Cr, Ni, Cu, and C in the flat steel product follow $1<0.5\%\ Mn+0.167\%\ Cr+0.125\%\ Ni+0.125\%\ Cu+1.334\%\ C<2$, wherein % Mn is an amount of Mn content in % by weight, wherein % Cr is an amount of Cr content in % by weight, wherein % Ni is an amount of Ni content in % by weight, wherein % Cu is an amount of Cu content in % by weight, and wherein % C is an amount of C content in % by weight.

3. The method of claim 1 wherein the flat steel product is provided with a metallic protective coating.

4. The method of claim 1 wherein the cold-rolled steel strip or steel sheet contains at least 50% by volume bainite.

5. The method of claim 1 wherein a sum content of Al and Si of the provided flat steel product is at least 1.5% by weight.

6. The method of claim 1 wherein the cooling of the flat steel product occurs in still air.

* * * * *